US012167800B2

(12) United States Patent
Hu

(10) Patent No.: US 12,167,800 B2
(45) Date of Patent: Dec. 17, 2024

(54) HANDLE ADJUSTMENT MECHANISM AND CHILD CRIB THEREWITH

(71) Applicant: Wonderland Switzerland AG, Steinhausen (CH)

(72) Inventor: Jun-Jie Hu, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 485 days.

(21) Appl. No.: 17/430,722

(22) PCT Filed: Nov. 13, 2020

(86) PCT No.: PCT/EP2020/082048
§ 371 (c)(1),
(2) Date: Aug. 12, 2021

(87) PCT Pub. No.: WO2021/094527
PCT Pub. Date: May 20, 2021

(65) Prior Publication Data

US 2022/0142375 A1 May 12, 2022

(30) Foreign Application Priority Data

Nov. 15, 2019 (CN) ..... 201911124105.7

(51) Int. Cl.
*A47D 7/02* (2006.01)
*A47D 9/00* (2006.01)
(Continued)

(52) U.S. Cl.
CPC ..... *A47D 7/02* (2013.01); *A47D 9/012* (2022.08); *A47D 9/02* (2013.01); *A47D 15/00* (2013.01)

(58) Field of Classification Search
None
See application file for complete search history.

(56) References Cited

U.S. PATENT DOCUMENTS 4,703,524 A 11/1987 Brunner
5,432,962 A 7/1995 Huang
(Continued)

FOREIGN PATENT DOCUMENTS

CN 103202634 A 7/2013
CN 204812998 U 12/2015
(Continued)

OTHER PUBLICATIONS

Examination Report issued in corresponding Australian Application No. 2020382899 dated Oct. 21, 2022.
(Continued)

*Primary Examiner* — Adam C Ortiz
(74) *Attorney, Agent, or Firm* — Volpe Koenig

(57) ABSTRACT

A handle adjustment mechanism (30) includes at least one stand (32) and an engaging structure (31). The at least one stand (32) is installed on a frame (10) of a child crib (100). A positioning structure (33) is on the at least one stand (32). The engaging structure (31) is coupled to a handle (20) of the child crib (100) and configured to engage with or disengage from the positioning structure (33) for adjusting a position of the handle (20) relative to the at least one stand (32) to position the handle (20) at different heights relative to the frame (10). The handle adjustment mechanism (30) is easy to operate for allowing a caregiver to put the child in or take the child out of the child crib (100).

26 Claims, 16 Drawing Sheets

(51) Int. Cl.
*A47D 9/02* (2006.01)
*A47D 15/00* (2006.01)

(56) References Cited

U.S. PATENT DOCUMENTS

| | | | | |
|---|---|---|---|---|
| 10,993,544 | B1 * | 5/2021 | Flannery | A47C 21/08 |
| 2003/0067193 | A1 | 4/2003 | Asbach et al. | |
| 2010/0162482 | A1 | 7/2010 | Cohen et al. | |
| 2011/0258776 | A1 | 10/2011 | Schwartz | |
| 2012/0005826 | A1 | 1/2012 | Bickley | |
| 2012/0297537 | A1 | 11/2012 | Gutierrez et al. | |
| 2018/0206651 | A1 | 7/2018 | Gallina | |
| 2018/0206652 | A1 | 7/2018 | Gallina | |

FOREIGN PATENT DOCUMENTS

| | | | | |
|---|---|---|---|---|
| CN | 107616642 | A | | 1/2018 |
| CN | 207767957 | U | * | 8/2018 |
| CN | 208259425 | U | | 12/2018 |
| CN | 208769250 | U | | 4/2019 |
| DE | 202014101886 | U1 | | 6/2014 |
| EP | 1053707 | A1 | | 11/2000 |
| EP | 2614754 | A1 | | 7/2013 |
| GB | 2287186 | A | | 9/1995 |
| JP | S4320521 | Y1 | | 8/1968 |
| JP | S45-28714 | Y | | 11/1970 |
| JP | S47-24363 | U | | 11/1972 |
| JP | 61-202247 | U | | 12/1986 |
| JP | 4-62271 | U | | 5/1992 |
| JP | 2002112859 | A | | 4/2002 |
| JP | 2009-536596 | A | | 10/2009 |
| JP | 2014-65363 | A | | 4/2014 |
| JP | 2018-3487 | A | | 1/2018 |
| KR | 20-0136932 | Y1 | | 4/1999 |
| TW | 326148 | | | 2/1998 |
| TW | M550089 | U | | 10/2017 |

OTHER PUBLICATIONS

Office Action issued in corresponding Chinese Application No. 201911124105.7 dated Sep. 4, 2023.

Search Report issued in corresponding Japanese Application No. 2021-536759 dated Jul. 15, 2022.

Notification to Grant Patent Right for Invention Issued in Corresponding Chinese Patent Application No. 201911124105.7, Mailed Date: Apr. 25, 2024, 6 pages.

Notice of Reasons for Refusal Issued in Corresponding Japanese Patent Application No. 2023-097701, Mailed Date: May 28, 2024, 12 pages.

Written Decision on Registration Issued in Corresponding Korean Patent Application No. 10-2021-7021049, Mailed Date: May 2, 2024, 5 pages.

Lian, et al., "Exploring and Applying the Multi-Functional Bed for Obstetric Examination", In Medical Device Information, Article No. 1007-7510 (2001) 05-0014-02, 2001, 9 pages.

"International Search Report" mailed on Jan. 29, 2021 for International application No. PCT/EP2020/082048, International filing date:Nov. 13, 2020.

* cited by examiner

HANDLE ADJUSTMENT MECHANISM AND CHILD CRIB THEREWITH

CROSS REFERENCE TO RELATED APPLICATIONS

This is a 371 U.S. National Phase of International Application No. PCT/EP2020/082048, filed on Nov. 13, 2020, which claims the benefit of CN Patent Application Ser. No. 201911124105.7, and the contents of this application are incorporated herein by reference.

FIELD OF THE INVENTION

The present invention relates to a handle adjustment mechanism and a child crib according to the pre-characterizing clauses of claims 1 and 19.

BACKGROUND OF THE INVENTION

Conventional child cribs usually include fixed handles whose heights are not adjustable. The fixed handles not only bring inconvenience to caregivers when putting their children in the cribs or taking their children from the cribs, but also cause a risk of collision injury to the children. In order to solve the aforementioned problem, some child cribs include frames and handles detachably installed on the frames. However, when the caregiver puts the child in or takes the child out of the crib, the detachment of the handles is complicated and creates bad user experiences for the caregiver.

SUMMARY OF THE INVENTION

This is mind, the present invention aims at providing a handle adjustment mechanism which allow a user to adjust a height of a handle by one hand and a child crib therewith.

This is achieved by a handle adjustment mechanism and a child crib according to claims 1 and 19. The dependent claims pertain to corresponding further developments and improvements.

As will be seen more clearly from the detail description following below, the claimed handle adjustment mechanism. The handle adjustment mechanism includes at least one stand and an engaging structure. The at least one stand is installed on a frame of a child crib. A positioning structure is on the at least one stand. The engaging structure is coupled to a handle of the child crib and configured to engage with or disengage from the positioning structure for adjusting a position of the handle relative to the at least one stand to position the handle at different heights relative to the frame.

According to an embodiment of the present invention, the engaging structure is engaged with the positioning structure by a cooperation between a protrusion and a recess structure.

According to an embodiment of the present invention, the engaging structure includes the recess structure, and the positioning structure includes the protrusion.

According to an embodiment of the present invention, the positioning structure includes an upper rib. The protrusion extends from a bottom portion of the upper rib, and the recess structure is a notch on the engaging structure.

According to an embodiment of the present invention, the engaging structure includes at least one connecting base disposed on at least one end of the handle. The notch is on the at least one connecting base, and the at least one connecting base is disposed on the at least one stand in a height-adjustable manner.

According to an embodiment of the present invention, the engaging structure includes at least one interlocking component and at least one movable component. A first end of the at least one interlocking component is configured to engage with the positioning structure. A second end of the at least one interlocking component is connected to the at least one movable component, and the at least one movable component is moved to drive the at least one interlocking component to engage with the positioning structure.

According to an embodiment of the present invention, the at least one interlocking component is slidable between a first position and a second position. The at least one interlocking component engages with the positioning structure when the at least one interlocking component is located at the first position, and the at least one interlocking component disengages from the positioning structure when the at least one interlocking component is located at the second position.

According to an embodiment of the present invention, the handle adjustment mechanism further includes a resilient component for driving the at least one interlocking component to slide to the first position.

According to an embodiment of the present invention, a hole is on the at least one interlocking component, and the handle adjustment mechanism further includes at least one pin slidably disposed in the hole.

According to an embodiment of the present invention, an inclined surface and a limiting portion are on the first end of the at least one interlocking component. The inclined surface is configured to cooperate with the positioning structure to drive the at least one interlocking component, and the limiting portion is configured to restrict movement of the at least one interlocking component.

According to an embodiment of the present invention, the inclined surface is inclined upwardly.

According to an embodiment of the present invention, the engaging structure further includes at least one operator for driving the at least one movable component when the at least one operator is operated.

According to an embodiment of the present invention, the handle adjustment mechanism further includes a base on the handle. The at least one operator is disposed on the base.

According to an embodiment of the present invention, the base includes at least one guiding slot extending horizontally. The at least one operator includes at least one driving slot. A first end of the at least one movable component is connected to the at least one interlocking component. A second end of the at least one movable component is disposed inside the at least one driving slot and the at least one guiding slot, and the second end of the at least one movable component is moved horizontally and inwardly by a cooperation between the second end of the at least one movable component, the at least one driving slot and the at least one guiding slot when the at least one operator slides.

According to an embodiment of the present invention, the handle includes at least one guiding slot extending horizontally. The at least one operator includes at least one driving slot. A first end of the at least one movable component is connected to the at least one interlocking component. A second end of the at least one movable component is disposed inside the at least one driving slot and the at least one guiding slot, and the second end of the at least one movable component is moved horizontally and inwardly by a cooperation between the second end of the at least one movable component, the at least one driving slot and the at least one guiding slot when the at least one operator rotates.

According to an embodiment of the present invention, the handle adjustment mechanism further includes a base and at least one slider. The base is on the handle. The at least one slider is disposed on the base. The at least one operator is rotatably disposed on the base. The at least one operator includes at least one driving block for driving the at least one slider to slide. A first end of the at least one movable component is connected to the at least one interlocking component. A second end of the at least one movable component is connected to the at least one slider, and the at least one operator rotates to drive the at least one slider to slide for driving the second end of the at least one movable component to move inwardly.

According to an embodiment of the present invention, the handle adjustment mechanism further includes a base and at least one gear. The base is on the handle. The at least one gear is disposed on the base. The at least one operator is disposed on the base for driving the at least one gear to rotate. The at least one gear includes a connector. A first end of the at least one movable component is connected to the at least one interlocking component. A second end of the at least one movable component is coupled to the connector, and the at least one operator is operated to drive the at least one gear to rotate for driving the second end of the at least one movable component to move inwardly.

According to an embodiment of the present invention, that the at least one gear includes two gears meshed with each other.

Furthermore, the claimed child crib includes a frame, a handle and a handle adjustment mechanism. The handle adjustment mechanism is for installing the handle on the frame in a height-adjustable manner. The handle adjustment mechanism includes at least one stand and an engaging structure. The at least one stand is installed on the frame. A positioning structure is on the at least one stand. The engaging structure is coupled to the handle and configured to engage with or disengage from the positioning structure for adjusting a position of the handle relative to the at least one stand to position the handle at different heights relative to the frame.

According to an embodiment of the present invention, the engaging structure includes a recess structure. The positioning structure includes a protrusion, and the engaging structure is engaged with the positioning structure by a cooperation between the protrusion and the recess structure.

According to an embodiment of the present invention, the positioning structure includes an upper rib. The protrusion extends from a bottom portion of the upper rib. The engaging structure includes at least one connecting base disposed on at least one end of the handle. The recess structure is a notch on the at least one connecting base, and the at least one connecting base is disposed on the at least one stand in a height-adjustable manner.

According to an embodiment of the present invention, the engaging structure includes at least one interlocking component and at least one movable component. A first end of the at least one interlocking component is configured to engage with the positioning structure. A second end of the at least one interlocking component is connected to the at least one movable component, and the at least one movable component is moved to drive the at least one interlocking component to engage with the positioning structure.

According to an embodiment of the present invention, the at least one interlocking component is slidable between a first position and a second position. The at least one interlocking component engages with the positioning structure when the at least one interlocking component is located at the first position, and the at least one interlocking component disengages from the positioning structure when the at least one interlocking component is located at the second position.

According to an embodiment of the present invention, a hole is on the at least one interlocking component, and the handle adjustment mechanism further includes at least one pin slidably disposed in the hole.

According to an embodiment of the present invention, an inclined surface and a limiting portion are on the first end of the at least one interlocking component. The inclined surface is inclined upwardly and configured to cooperate with the positioning structure to drive the at least one interlocking component, and the limiting portion is configured to restrict movement of the at least one interlocking component.

According to an embodiment of the present invention, the engaging structure further includes at least one operator for driving the at least one movable component when the at least one operator is operated.

According to an embodiment of the present invention, the handle adjustment mechanism further includes a base on the handle. The at least one operator is disposed on the base.

According to an embodiment of the present invention, the base includes at least one guiding slot extending horizontally. The at least one operator includes at least one driving slot. A first end of the at least one movable component is connected to the at least one interlocking component. A second end of the at least one movable component is disposed inside the at least one driving slot and the at least one guiding slot, and the second end of the at least one movable component is moved horizontally and inwardly by a cooperation between the second end of the at least one movable component, the at least one driving slot and the at least one guiding slot when the at least one operator slides.

According to an embodiment of the present invention, the handle includes at least one guiding slot extending horizontally. The at least one operator includes at least one driving slot. A first end of the at least one movable component is connected to the at least one interlocking component. A second end of the at least one movable component is disposed inside the at least one driving slot and the at least one guiding slot, and the second end of the at least one movable component is moved horizontally and inwardly by a cooperation between the second end of the at least one movable component, the at least one driving slot and the at least one guiding slot when the at least one operator rotates.

According to an embodiment of the present invention, the handle adjustment mechanism further includes a base and at least one slider. The base is on the handle. The at least one slider is disposed on the base. The at least one operator is rotatably disposed on the base. The at least one operator includes at least one driving block for driving the at least one slider to slide. A first end of the at least one movable component is connected to the at least one interlocking component. A second end of the at least one movable component is connected to the at least one slider, and the at least one operator rotates to drive the at least one slider to slide for driving the second end of the at least one movable component to move inwardly.

According to an embodiment of the present invention, the handle adjustment mechanism further includes a base and at least one gear. The base is on the handle. The at least one gear is disposed on the base. The at least one operator is disposed on the base for driving the at least one gear to rotate. The at least one gear includes a connector. A first end of the at least one movable component is connected to the at least one interlocking component. A second end of the at least one movable component is coupled to the connector, and the at least one operator is operated to drive the at least one gear to rotate for driving the second end of the at least one movable component to move inwardly.

According to an embodiment of the present invention, that the at least one gear includes two gears meshed with each other.

Comparing to the conventional child crib, in the present invention, the height of the handle can be adjusted by engagement or disengagement of the engaging structure and the positioning structure. When it is desired to lower the handle, the operator can be used to drive the two movable components to disengage the two interlocking components from the two upper ribs for lowering the handle. When it is desired to lift the handle, the use of the operator is not required, and the handle can be directly pulled upward due to the shape of the inclined surface. Therefore, the present invention provides the handle adjustment mechanism of the child crib that is easy to operate for the caregiver.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

In the following, the invention is further illustrated by way of example, taking reference to the accompanying drawings. Thereof

DETAILED DESCRIPTION

In order to illustrate technical specifications and structural features as well as achieved purposes and effects of the present invention, relevant embodiments and figures are described as follows.

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, the term "connect" or "couple" is intended to mean either an indirect or direct mechanical connection. Thus, if a first device is connected or coupled to a second device, that connection may be through a direct mechanical connection, or through an indirect mechanical connection via other devices and connections.

Figure 1:
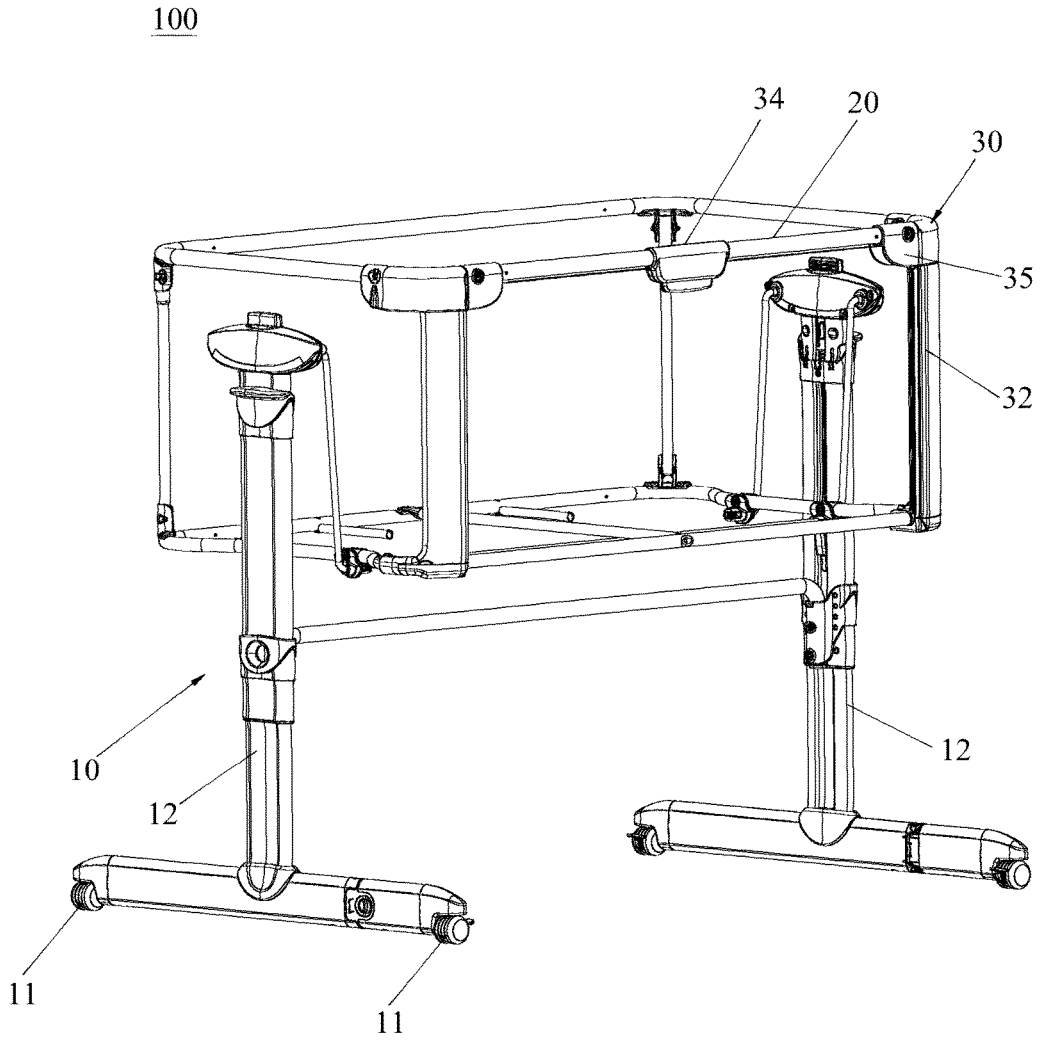
FIG. 1 is a schematic diagram of a child crib in a first state according to a first embodiment of the present invention.
Figure 2:
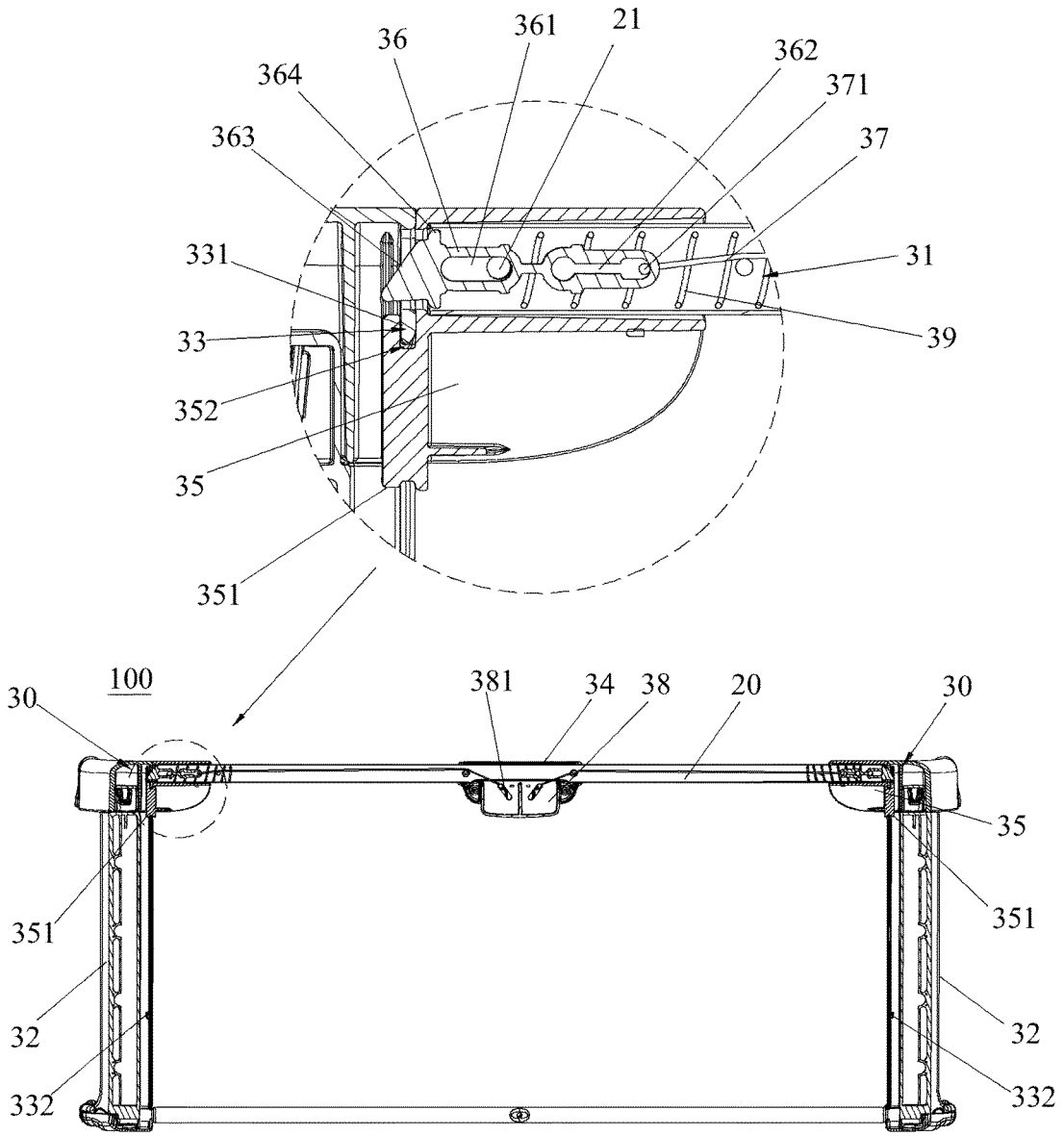
FIG. 2 is a partial sectional diagram of the child crib shown in FIG. 1 according to the first embodiment of the present invention.
Figure 3:
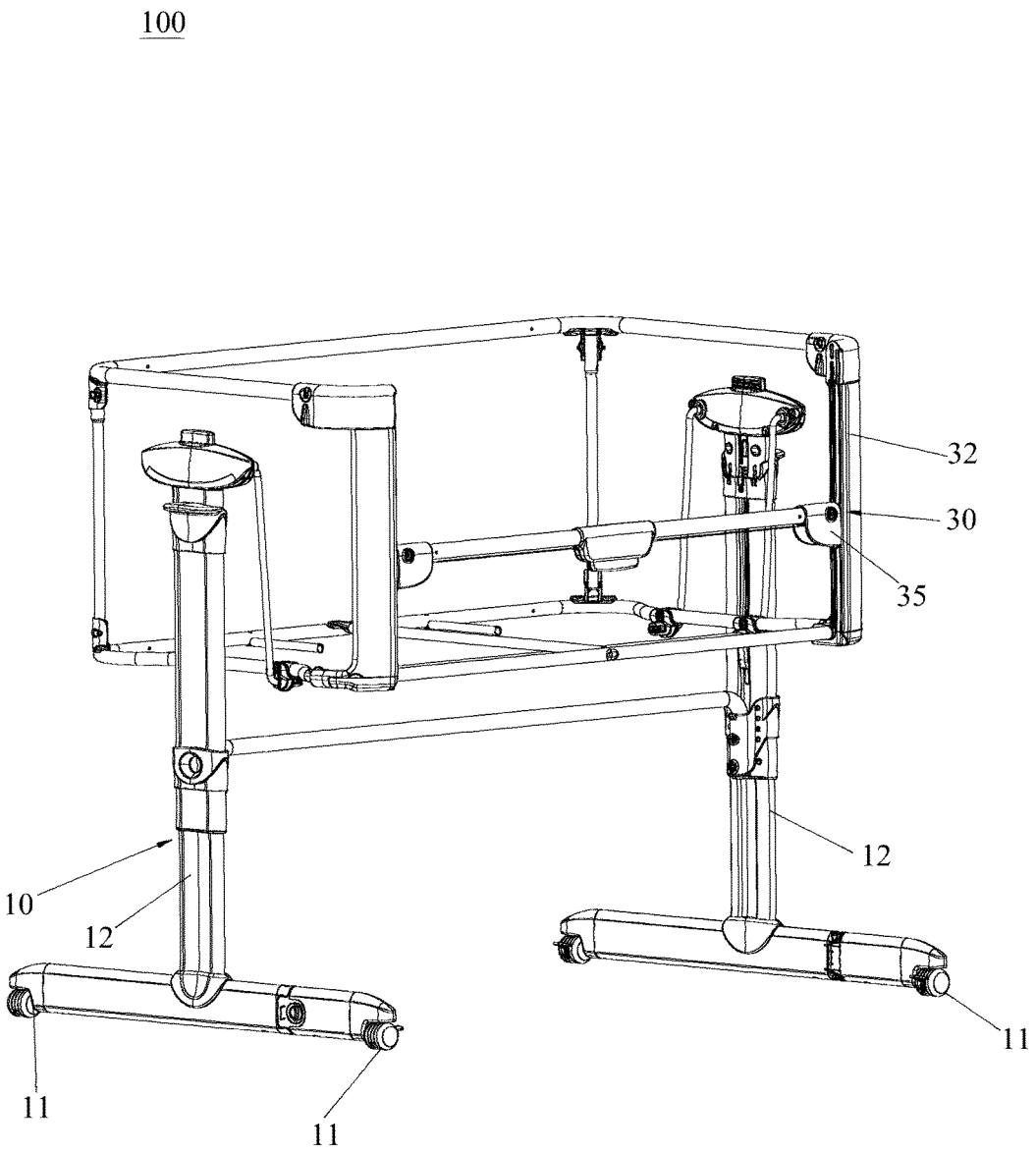
FIG. 3 is a diagram of the child crib in a second state according to the first embodiment of the present invention.
Figure 4:
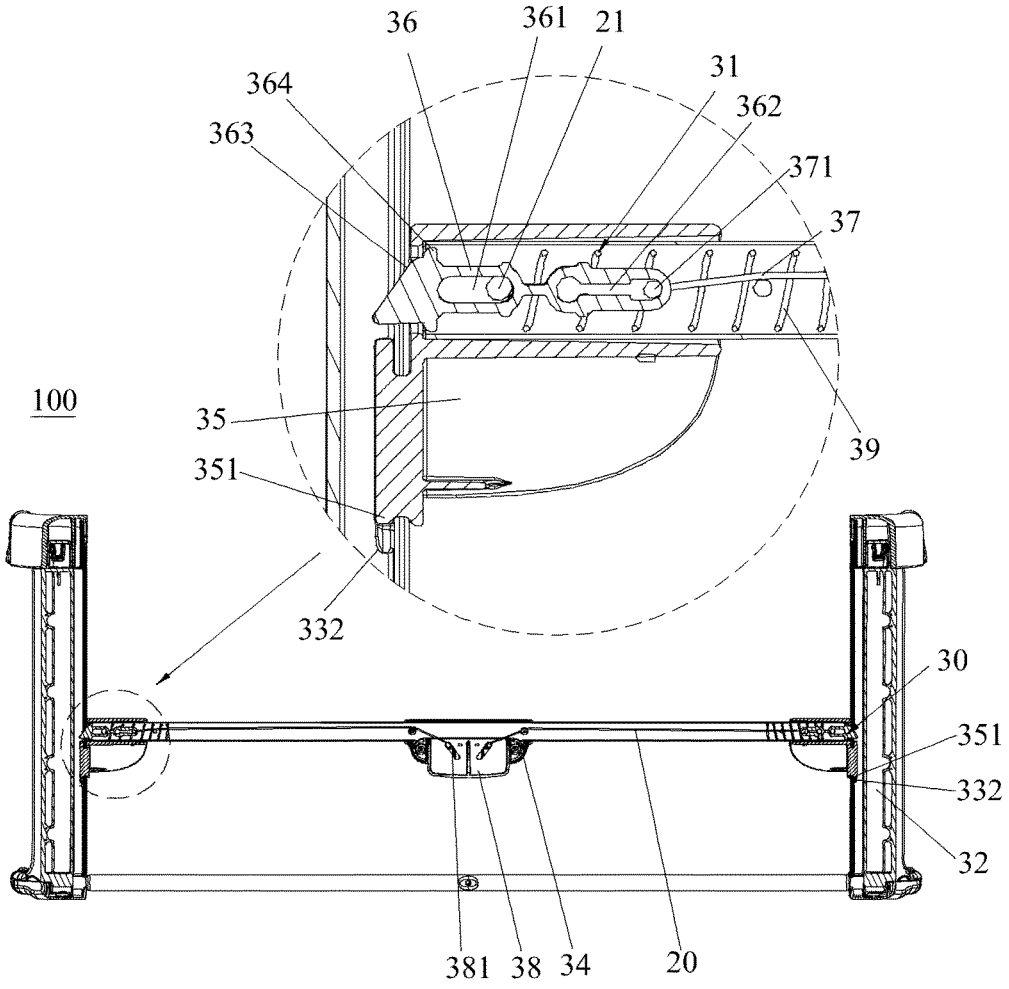
FIG. 4 is a partial sectional diagram of the child crib shown in FIG. 3 according to the first embodiment of the present invention.
Figure 5:
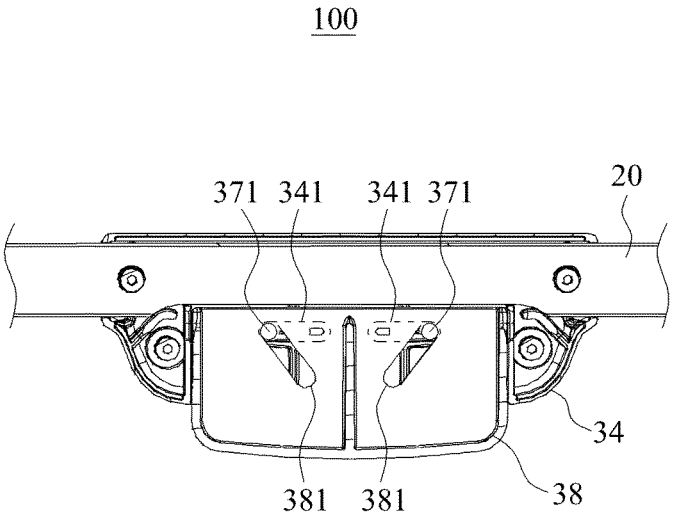
FIG. 5 is another partial sectional diagram of the child crib according to the first embodiment.
Figure 6:
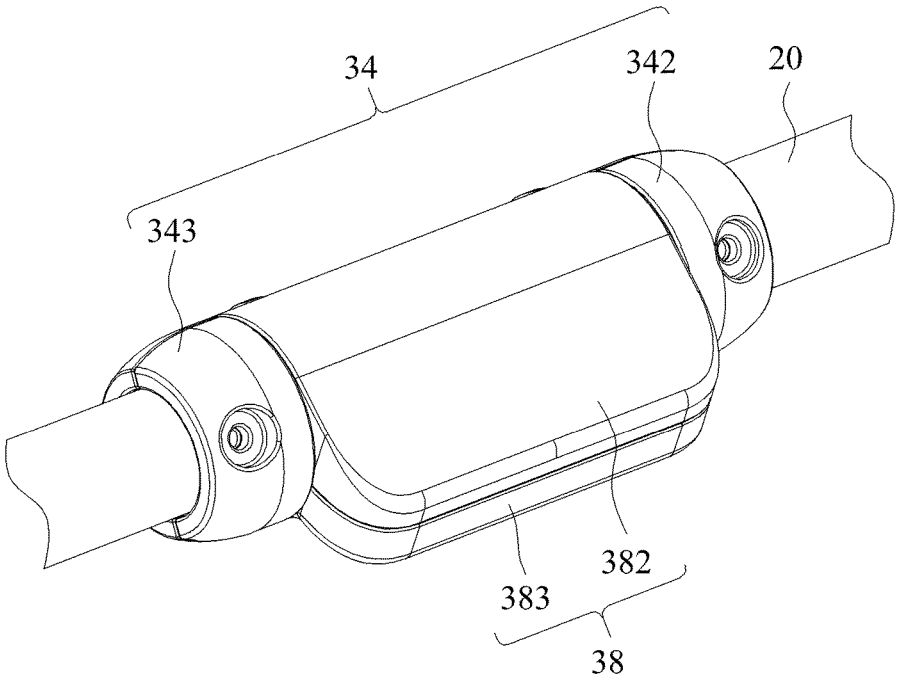
FIG. 6 to FIG. 9 are different partial diagrams of a child crib according to the second embodiment of the present invention.
Figure 7:
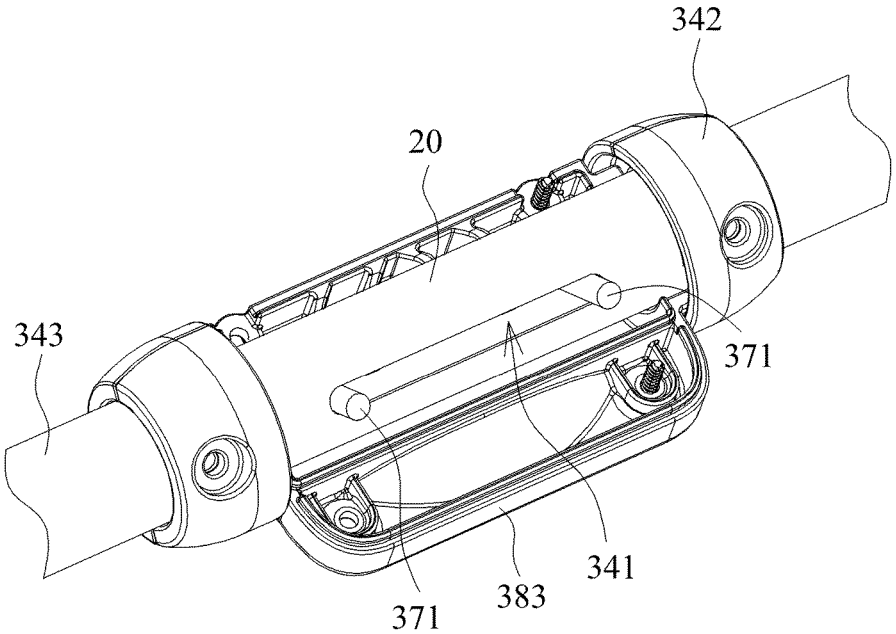
Figure 8:
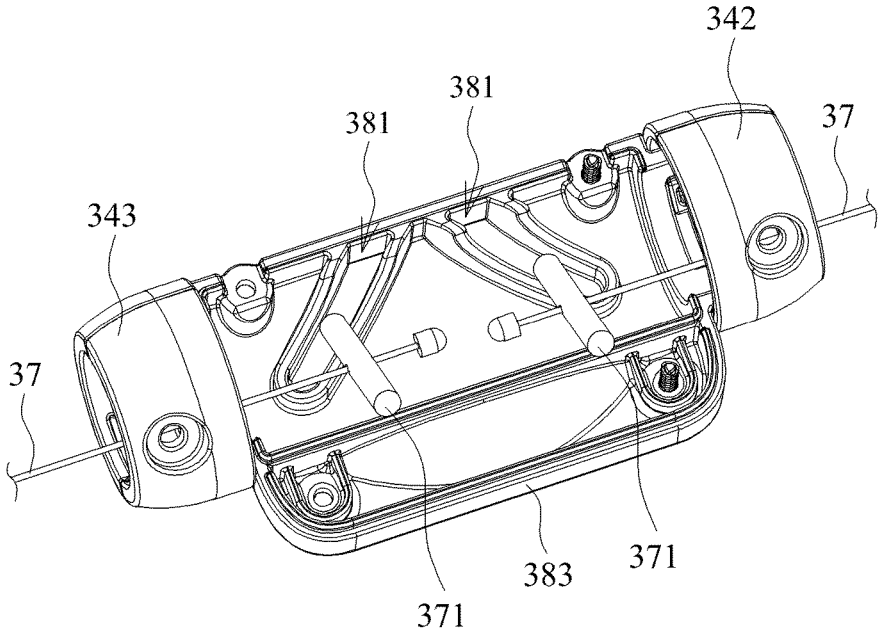
Figure 9:
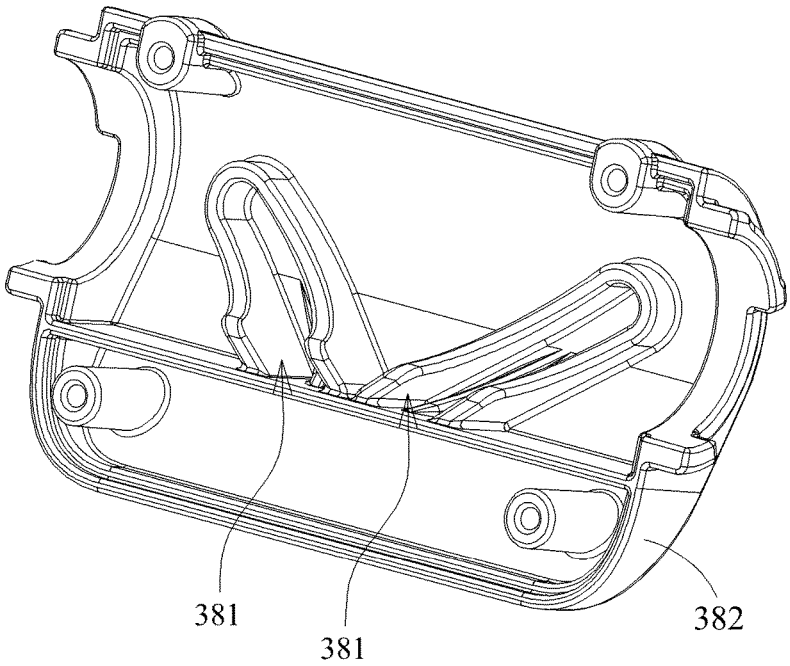
Figure 10:
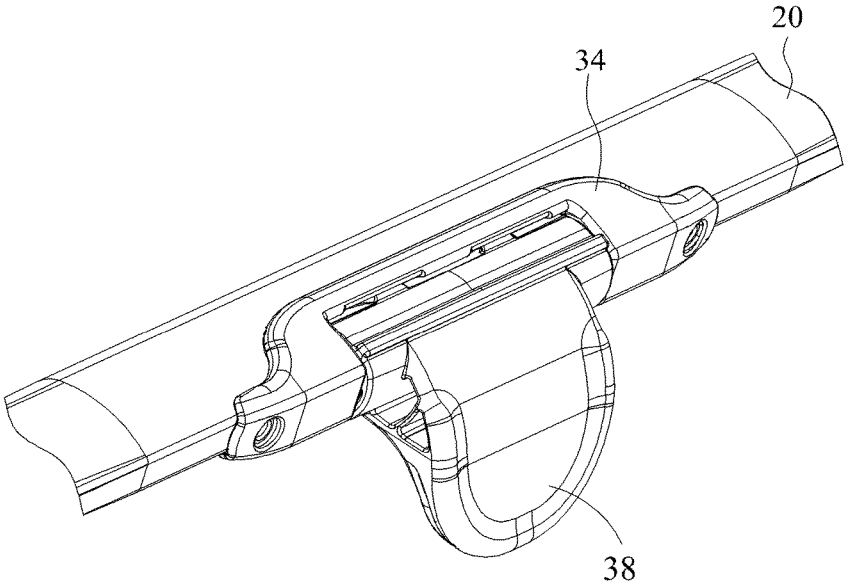
FIG. 10 to FIG. 13 are different partial diagrams of a child crib according to a third embodiment of the present invention.
Figure 11:
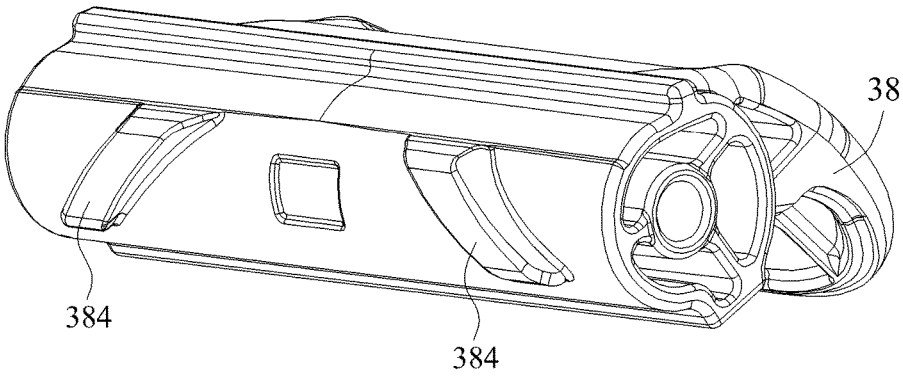
Figure 12:
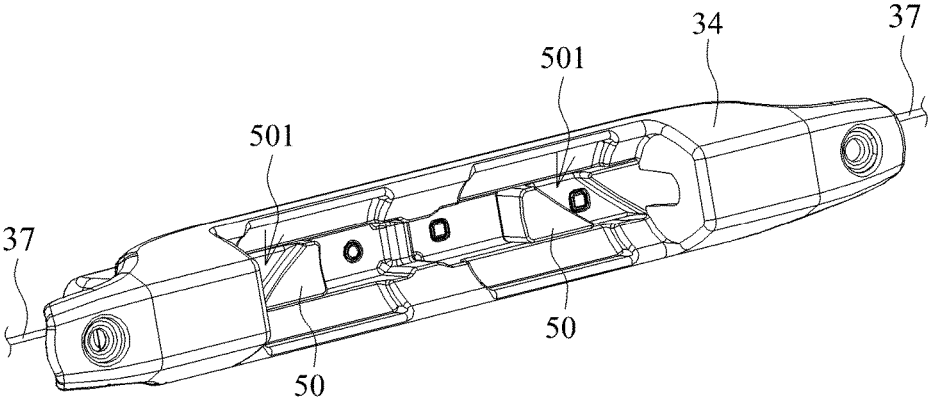
Figure 13:
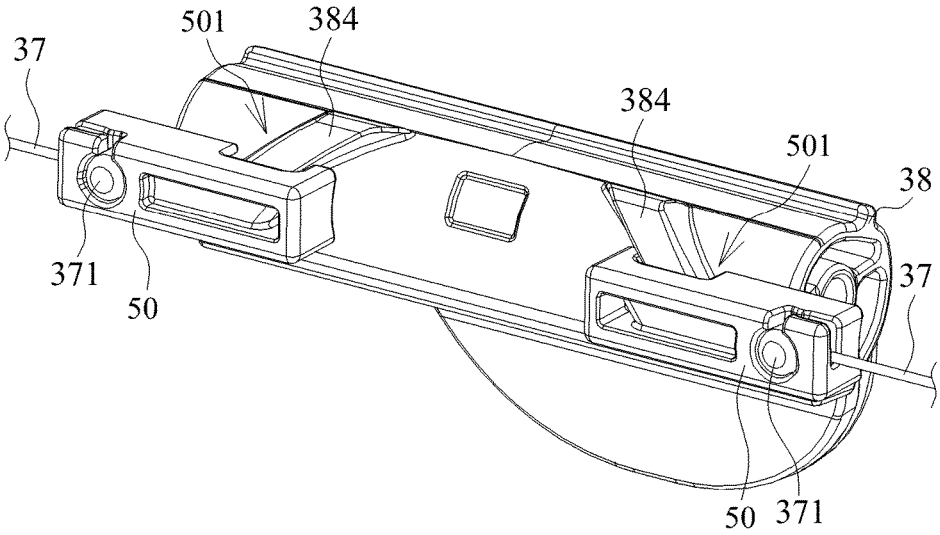

Please refer to FIG. 1 to FIG. 5. FIG. 1 is a schematic diagram of a child crib 100 in a first state according to a first embodiment of the present invention. FIG. 2 is a partial sectional diagram of the child crib 100 shown in FIG. 1 according to the first embodiment of the present invention. FIG. 3 is a diagram of the child crib 100 in a second state according to the first embodiment of the present invention. FIG. 4 is a partial sectional diagram of the child crib 100 shown in FIG. 3 according to the first embodiment of the present invention. FIG. 5 is another partial sectional diagram of the child crib 100 according to the first embodiment. As shown in FIG. 1 and FIG. 3, the child crib 100 includes a frame 10, a handle 20 and a handle adjustment mechanism 30. The handle adjustment mechanism 30 is for installing the handle 20 on the frame 10, and the height of the handle 20 can be changed by using the handle adjustment mechanism 30. When the child crib 100 is switched from the first state as shown in FIG. 1 to the second state as shown in FIG. 3, the handle 20 is moved from a highest position as shown in FIG. 1 to a lowest position as shown in FIG. 3.

As shown in FIG. 2 and FIG. 4, the handle adjustment mechanism 30 includes an engaging structure 31 and two stands 32. The engaging structure 31 is coupled to the handle 20. The two stands 32 are installed on the frame 10 and located at two adjacent corners of the frame 10. A positioning structure 33 is on each of the stands 32 for disposing the handle 20 at different heights. The engaging structure 31 can engage with or disengage from the two positioning structures 33 on the two stands 32, so that a height of the handle 20 relative to the two stands 32 can be adjusted by the engagement and/or disengagement between the engaging structure 31 and the two positioning structures 33. The handle adjustment mechanism 30 adjusts the height of the handle 20 relative to the frame 10. This is a convenient approach for a caregiver to put a child in or take the child from the child crib 100.

In this embodiment, the frame 10 includes a plurality of wheels 11 and a plurality of feet 12. The feet 12 are retractable for adjusting a height of the entire child crib 100. Each of the wheels 11 is respectively installed on a bottom portion of a corresponding one of the feet 12 for moving the entire child crib 100. However, the present invention is not limited to the aforementioned. For example, the frame can include only four feet with no wheels. Alternatively, both the foot and the wheel can be omitted in another embodiment.

As shown in FIG. 2 and FIG. 4, the engaging structure 31 includes two interlocking components 36. Specifically, as shown in FIG. 2, each of the positioning structures 33 can include an upper rib 331 at an upper portion of the corresponding stand 32. When the handle 20 is positioned at the highest position as shown in FIG. 1 and FIG. 2, each of the interlocking components 36 is abutting against a top portion of the corresponding upper rib 331. Thus, the handle 20 is placed at the highest position relative to the two stands 32. The interaction between of the engaging structure and the positioning structures of the present invention is not limited to the aforementioned. In another embodiment, each of the positioning structures can include a hollow structure, such as an aperture, a gap, or a slot, for placing the interlocking component.

In the embodiment shown in FIG. 2 and FIG. 4, the engaging structure 31 can include two connecting bases 35 respectively disposed on two opposite ends of the handle 20. Each of the connecting bases 35 is on the corresponding stand 32 in a height-adjustable manner and can engage with or disengage from the corresponding upper rib 331. Specifically, each of the positioning structures 33 includes a protrusion, and each of the connecting bases 35 includes a recess structure for engaging with or disengaging from the protrusion. As shown in FIG. 3 and FIG. 4, each of the protrusions may extend from a bottom portion of the corresponding upper rib 331, and each of the recess structures can be a notch 352 on a top portion of the corresponding connecting base 35. Each of the notches 352 engages with the corresponding protrusion extending from the bottom portion of the corresponding upper rib 331. When the handle 20 is placed at the highest position as shown in FIG. 1 and FIG. 2, each of the interlocking components 36 engages with the corresponding upper rib 331 at the corresponding stand 32, and each of the protrusions engages with the corresponding notch 352. The upper rib 331 and the corresponding notch 352 can be configured in such a way that a distance between the interlocking component 36 and the corresponding connecting base 35 is consistent even with the presence of the corresponding upper rib 331. Thus, the structure of the child crib 100 would be more compact. The shapes of the connecting base and the positioning structure are not limited to the aforementioned. In another embodiment, each of the connecting bases can include a protrusion, and each of the positioning structures can include a recess structure for engaging with the corresponding protrusion.

As shown in FIG. 2 and FIG. 4, the engaging structure 31 further includes two movable components 37 and an operator 38 for driving movements of the two movable components 37. A first end of each of the interlocking components 36 is configured to be engaged with the corresponding upper rib 331. A second end of each of the interlocking components 36 is connected to the operator 38 by the corresponding movable component 37. The operator 38 can be used for the two movable components 37 to be moved in a longitudinal direction of the handle 20, and therefore the interlocking components 36 are disengaged from the two upper ribs 331. The longitudinal direction of the handle 20 can be a horizontal direction.

Furthermore, an engaging portion 351 can be on a bottom end of each of the connecting bases 35, and each of the positioning structures 33 can further include a lower rib 332. When the handle 20 is positioned at the lowest position as shown in FIG. 3 and FIG. 4, each of the connecting bases 35 can be positioned by an engagement between the corresponding engaging portion 351 and the corresponding lower rib 332, and the height of the handle 20 would be at the lowest position relative to the corresponding stand 32. However, the placement of the handle in the lowest position is not limited to the aforementioned. In another embodiment, an indent can be on the bottom end of each of the connecting bases for engaging with the corresponding lower rib when the handle 20 is positioned at the lowest position.

Preferably, an inclined surface 363 is on the first end of each of the interlocking components 36 and inclined upwardly. The inclined surface 363 allows the handle 20 to be lifted upward without using the operator 38. Specifically, the inclined surface 363 has a ramp shape. With the ramp shape of the inclined surface 363, the caregiver is able to lift the handle 20 with minimum resistance by one hand.

As shown in FIG. 3, each of the interlocking components 36 includes a limiting portion 364 and a hole 361. The limiting portion 364 and the hole 361 restrict movements of each of the interlocking components 36. Each of the limiting portions 364 abuts against the corresponding connecting base 35 to restrict movements of each of the interlocking components 36. The handle adjustment mechanism 30 further includes two pins 21, and the two pins 21 are respectively slidably disposed in the two holes 361. When each of the interlocking components 36 moves along the longitudinal direction of the handle 20, each of the pins 21 can move within to the corresponding hole 361, to carry each of the interlocking components 36. With the aforementioned configuration, each of the interlocking components 36 can move between a first position and a second position. When each of the interlocking components 36 is located at the first position, each of the interlocking components 36 engages with the corresponding upper rib 331. When each of the interlocking components 36 is located at the second position, each of the interlocking components 36 disengages from the corresponding upper rib 331.

Specifically, as shown in FIG. 2 and FIG. 5, each of the interlocking components 36 further includes a channel 362. The handle adjustment mechanism 30 further includes a base 34 on a middle portion of the handle 20. The operator 38 is disposed on the base 34. The base 34 includes two guiding slots 341, and the guiding slots 341 extend horizontally. The operator 38 includes two driving slots 381. A first end of each of the movable components 37 is inserted into the channel 362 on the corresponding interlocking component 36. A second end of each of the movable components 37 is disposed inside the corresponding driving slot 381 and the corresponding guiding slot 341. More specifically, each of the movable components 37 can be a metal wire with two pins 371 at two ends. Furthermore, the pin 371 at the second end of the movable component 37 can be inserted into the driving slot 381 and the guiding slot 341, and the pin 371 at the first end of the movable component 37 can be inserted into the channel 362. Each driving slot 381 is for driving movement of the corresponding pin 371. The pin 371 can be moved within the guiding slot 341. The operator 38 triggers the second ends of the movable components 37 to be moved horizontally and inwardly by a cooperation between the pins 371, the driving slots 381 and the guiding slots 341. The caregiver may hold the operator 38 with a palm on the handle 20 and fingers on a bottom of the operator 38, and press the operator 38 with the fingers so that the pin 371 would slide within the guiding slot 341 and the driving slot 381.

Moreover, the engaging structure 31 further includes two resilient components 39 respectively coupled to the two interlocking components 36. The interlocking components 36 are moved by the resilient components 39 to the first position and engaged with the corresponding upper ribs 331. When each of the interlocking components 36 is moved from the first position to the second position, the corresponding resilient component 39 is compressed. In this embodiment, each of the resilient components 39 can be disposed between the corresponding interlocking component 36 and the operator 38. After the two interlocking components 36 being disengaged from the two upper ribs 331 by using the operator 38, the resilient components 39 can be released to drive the two interlocking components 36, and the interlocking components 36 then engage with the two upper ribs 331. Thus, the handle 20 is at the highest position relative to the corresponding stand 32. The compression and release of the resilient components 39 are driven by the operator 38. Specifically, the caregiver may press the bottom of the operator 38 with the fingers so that the resilient component 39 is compressed; the caregiver may also not to press the operator 38 so that the resilient component 39 is released. In this embodiment, each of the resilient components 39 can be a spring However, the placement of the resilient component is not limited to the aforementioned. In another embodiment, the resilient component also can be any structure made of elastic material, such as a leaf spring or a rubber, and disposed between the handle and the interlocking component.

The present invention may be operated in the following manner. When it is desired to lower the handle 20, the operator 38 can be used to drive the two movable components 37 by the cooperation between the pins 371, the driving slots 381 and the guiding slots 341. The cooperation drives the two interlocking components 36 to disengage from the two upper ribs 331, thus the handle 20 can be lowered. When it is desired to lift the handle 20, it is not required to use the operator 38, and the handle 20 can be directly pulled upward due to the shape of the inclined surface 363. Specifically, while the handle 20 is moved from the lowest position to the highest position, each of the interlocking components 36 can be driven to move from the first position to the second position by a cooperation between the corresponding inclined surface 363 and the bottom portion of the corresponding upper rib 331, so as to compress the corresponding resilient component 39 for the handle 20 to be lifted with minimum resistance. After the operator 38 is released, each of the interlocking components 36 can be driven to move from the second position to the first position to engage with the corresponding upper rib 331 by abutting against the top portion of the corresponding upper rib 331.

Additionally, the amounts of the stand, the connecting base, the interlocking component, the movable component, the operator, the pin, the driving slot and the guiding slot are not limited to the aforementioned. In another embodiment, the engaging structure can include two operators for driving the movements of the two movable components independently, wherein there is only one driving slot on each of the operators for connecting the corresponding movable component. In another embodiment, the positioning structure can include only one stand at one corner of the frame, and the engaging structure can include only one interlocking component, one upper rib, one operator and one movable component, wherein there is only one driving slot on the operator for connecting the movable component and one pin disposed on the handle and slidably disposed within the hole on the interlocking component.

The driving mechanism for driving the interlocking component is not limited to the aforementioned. Please refer to FIG. 6 to FIG. 9. FIG. 6 to FIG. 9 are different partial diagrams of the child crib according to the second embodiment of the present invention. As shown in FIG. 6 to FIG. 9, the operator 38 is rotatably disposed on the handle 20 by the base 34. Specifically, the operator 38 includes a first portion 382 and a second portion 383 detachably combined with the first portion 382. The base 34 includes a first base portion 342 fixed on the handle 20 and a second base portion 343 fixed on the handle 20 and spaced from the first base portion 342. Two ends of the operator 38 are respectively rotatably connected to the first base portion 342 and the second base portion 343.

Each of the first portion 382 and the second portion 384 includes the two driving slots 381. The handle 20 includes the guiding slot 341 extending horizontally. The pin at the first end of each of the movable components 37 is connected to the corresponding interlocking component. The pin 371 at the second end of each of the movable components 37 is disposed inside the corresponding driving slots 381 and the guiding slot 341. Therefore, the second end of each of the movable components 37 is moved horizontally and inwardly by a cooperation between the second end of each of the movable components 37, the corresponding driving slot 381 and the guiding slot 341 for driving the interlocking components to disengage from the upper ribs when the operator 38 is operated to rotate relative to the handle 20.

The amounts of the guiding slot, the driving slot, the operator are not limited to aforementioned. It depends on practical demands. For example, if there is only one interlocking component and one movable component, there can be one guiding slot, one driving slot and one operator.

Please refer to FIG. 10 to FIG. 13. FIG. 10 to FIG. 13 are different partial diagrams of the child crib according to a third embodiment of the present invention. As shown in FIG. 10 to FIG. 13, the handle adjustment mechanism includes the base 34 on the handle 20 and two sliders 50 disposed on the base 34. The operator 38 is rotatably disposed on the base 34 for driving the two sliders 50 to slide. The operator 38 includes two driving blocks 384. Each of the sliders 50 includes a driving recess 501 for cooperating the corresponding driving block 384. The operator 38 rotates to drive the two sliders 50 to slide by the driving blocks 384 and the driving recesses 501. The pin 371 at the first end of each of the movable components 37 is connected to the corresponding interlocking component. The pin 371 at the second end of each of the movable components 37 is connected to the corresponding slider 50. Therefore, the second end of each of the movable components 37 is moved horizontally and inwardly by a cooperation between the second end of each of the movable components 37, the corresponding driving block 384 and the corresponding slider 50 for driving the interlocking components to disengage from the upper ribs when the operator 38 is operated to rotate relative to the base 34.

The amounts and the configurations of the operator, the driving block, the slider and the driving recess are not limited to aforementioned. It depends on practical demands. For example, if there is only one interlocking component and one movable component, there can be one operator, one slider, one driving block on the slider, and one driving recess on the operator.

Figure 14:
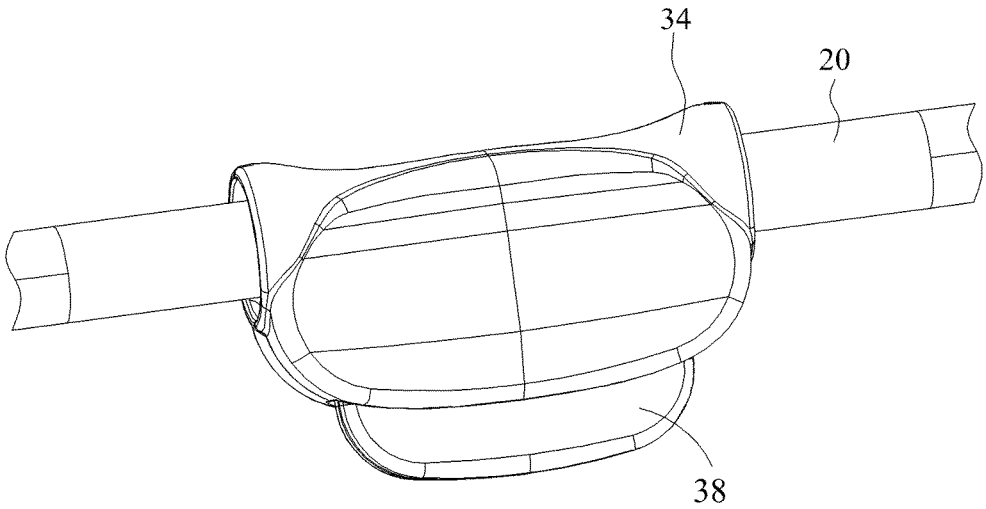
FIG. 14 to FIG. 16 are different partial diagrams of a child crib according to a fourth embodiment of the present invention.
Figure 15:
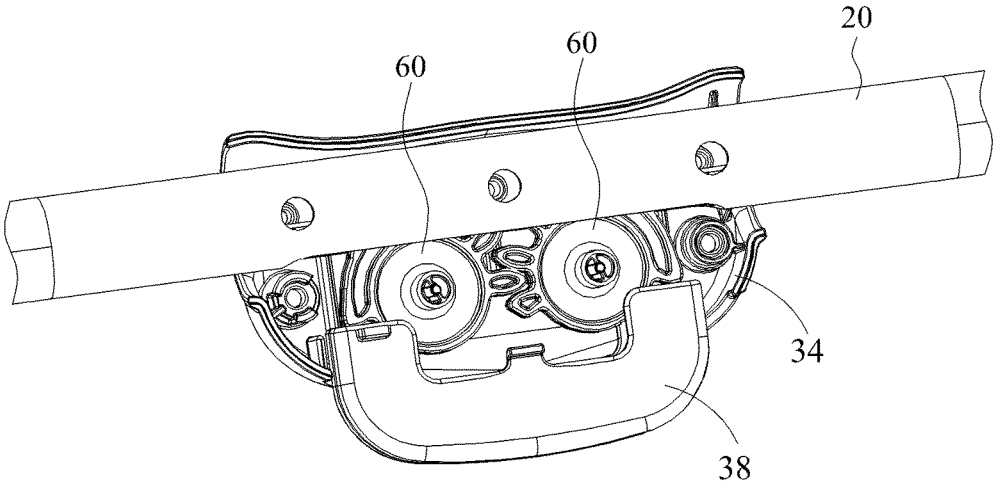
Figure 16:
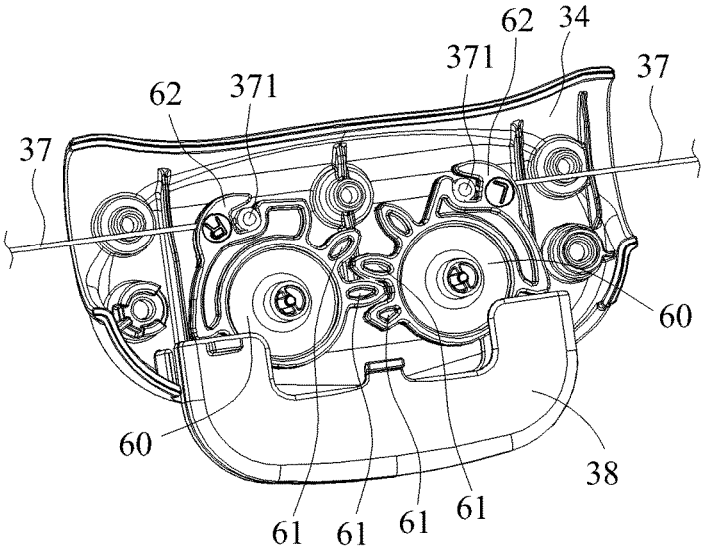

Please refer to FIG. 14 to FIG. 16. FIG. 14 to FIG. 16 are different partial diagrams of the child crib according to a fourth embodiment of the present invention. As shown in FIG. 14 to FIG. 16, the handle adjustment mechanism includes the base 34 on the handle and two gears 60 disposed on the base 34, wherein each of the two gears 60 is meshed with another of the gears 60. The operator 38 is disposed on the base 34 for driving the two gears 60 to rotate. Each of the gears 60 comprises a plurality of teeth 61 on a side of the gear 60, and a connector 62 for coupling with the pin 371. The pin at the first end of each of the movable components 37 is connected to the corresponding interlocking component. The pin 371 at the second end of each of the movable components 37 is connected to the corresponding gear 60. Specifically, the pin 371 is coupled to the connector 62 of the gear 60. Therefore, the operator 38 can be operated or pressed to drive the two gears 60 to rotate in two different directions for driving the second end of each of the movable components 37 to move inwardly to drive the interlocking components to disengage from the upper ribs when the operator 38 is operated to slide relative to the base 34.

The amounts of the gear and the operator are not limited to aforementioned. It depends on practical demands. For example, if there is only one interlocking component and one movable component, there can be one gear and one operator.

In this embodiment, the two gears 60 can be rotatably engaged with each other, so that the two gears 60 can rotate in the two opposite directions synchronously to drive the two interlocking components synchronously.

In the present invention, the height of the handle can be adjusted by engagement or disengagement of the engaging structure and the positioning structure. When it is desired to lower the handle, the operator can be used to drive the two movable components to disengage the two interlocking components from the two upper ribs for lowering the handle. When it is desired to lift the handle, the use of the operator is not required, and the handle can be directly pulled upward due to the shape of the inclined surface. Therefore, the present invention provides the handle adjustment mechanism of the child crib that is easy to operate for the caregiver.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A handle adjustment mechanism, the handle adjustment mechanism comprising:

at least one stand installed on a frame of a child crib, a positioning structure being on the at least one stand; and an engaging structure coupled to a handle of the child crib and configured to engage with or disengage from the positioning structure for adjusting a position of the handle relative to the at least one stand to position the handle at different heights relative to the frame, wherein the engaging structure is engaged with the positioning structure by a cooperation between a protrusion and a recess structure, wherein the engaging structure comprises the recess structure, and the positioning structure comprises the protrusion, wherein the positioning structure comprises an upper rib, the protrusion extends from a bottom portion of the upper rib, and the recess structure is a notch on the engaging structure, wherein the engaging structure comprises at least one interlocking component and at least one movable component, a first end of the at least one interlocking component is configured to engage with the positioning structure, a second end of the at least one interlocking component is connected to the at least one movable component, and the at least one movable component is moved to drive the at least one interlocking component to engage with the positioning structure.

2. The handle adjustment mechanism of claim 1, wherein the engaging structure comprises at least one connecting base disposed on at least one end of the handle, the notch is on the at least one connecting base, and the at least one connecting base is disposed on the at least one stand in a height-adjustable manner.

3. The handle adjustment mechanism of claim 1, wherein the at least one interlocking component is slidable between a first position and a second position, the at least one interlocking component engages with the positioning structure when the at least one interlocking component is located at the first position, and the at least one interlocking component disengages from the positioning structure when the at least one interlocking component is located at the second position.

4. The handle adjustment mechanism of claim 3, wherein the handle adjustment mechanism further comprises a resilient component for driving the at least one interlocking component to slide to the first position.

5. The handle adjustment mechanism of claim 3, wherein a hole is on the at least one interlocking component, and the handle adjustment mechanism further comprises at least one pin slidably disposed in the hole.

6. The handle adjustment mechanism of claim 1, wherein an inclined surface and a limiting portion are on the first end of the at least one interlocking component, the inclined surface is configured to cooperate with the positioning structure to drive the at least one interlocking component, and the limiting portion is configured to restrict movement of the at least one interlocking component.

7. The handle adjustment mechanism of claim 6, wherein the inclined surface is inclined upwardly.

8. The handle adjustment mechanism of claim 1, wherein the engaging structure further comprises at least one operator for driving the at least one movable component when the at least one operator is operated.

9. The handle adjustment mechanism of claim 8, wherein the handle adjustment mechanism further comprises a base on the handle, the at least one operator is disposed on the base.

10. The handle adjustment mechanism of claim 9, wherein the base comprises at least one guiding slot extending horizontally, the at least one operator comprises at least one driving slot, a first end of the at least one movable component is connected to the at least one interlocking component, a second end of the at least one movable component is disposed inside the at least one driving slot and the at least one guiding slot, and the second end of the at least one movable component is moved horizontally and inwardly by a cooperation between the second end of the at least one movable component, the at least one driving slot, and the at least one guiding slot when the at least one operator slides.

11. The handle adjustment mechanism of claim 9, wherein the handle comprises at least one guiding slot extending horizontally, the at least one operator comprises at least one driving slot, a first end of the at least one movable component is connected to the at least one interlocking component, a second end of the at least one movable component is disposed inside the at least one driving slot and the at least one guiding slot, and the second end of the at least one movable component is moved horizontally and inwardly by a cooperation between the second end of the at least one movable component, the at least one driving slot and the at least one guiding slot when the at least one operator rotates.

12. The handle adjustment mechanism of claim 8, wherein the handle adjustment mechanism further comprises a base and at least one slider, the base is on the handle, the at least one slider is disposed on the base, the at least one operator is rotatably disposed on the base for driving the at least one slider to slide, a first end of the at least one movable component is connected to the at least one interlocking component, a second end of the at least one movable component is connected to the at least one slider, and the at least one operator rotates to drive the at least one slider to slide for driving the second end of the at least one movable component to move inwardly.

13. The handle adjustment mechanism of claim 8, wherein the handle adjustment mechanism further comprises a base and at least one gear, the base is on the handle, the at least one gear is disposed on the base, the at least one operator is disposed on the base for driving the at least one gear to rotate, the at least one gear comprises a connector, a first end of the at least one movable component is connected to the at least one interlocking component, a second end of the at least one movable component is coupled to the connector, and the at least one operator is operated to drive the at least one gear to rotate for driving the second end of the at least one movable component to move inwardly.

14. The handle adjustment mechanism of claim 13, wherein the at least one gear comprises two gears meshed with each other.

15. A child crib comprising:

a frame;

a handle; and a handle adjustment mechanism for installing the handle on the frame in a height-adjustable manner, the handle adjustment mechanism comprising:

at least one stand installed on the frame, a positioning structure being on the at least one stand; and an engaging structure coupled to the handle and configured to engage with or disengage from the positioning structure for adjusting a position of the handle relative to the at least one stand to position the handle at different heights relative to the frame, wherein the engaging structure comprises a recess structure, the positioning structure comprises a protrusion, and the engaging structure is engaged with the positioning structure by a cooperation between the protrusion and the recess structure, wherein the positioning structure comprises an upper rib, the protrusion extends from a bottom portion of the upper rib, and the recess structure is a notch on the engaging structure, wherein the engaging structure comprises at least one interlocking component and at least one movable component, a first end of the at least one interlocking component is configured to engage with the positioning structure, a second end of the at least one interlocking component is connected to the at least one movable component, and the at least one movable component is moved to drive the at least one interlocking component to engage with the positioning structure.

16. The child crib of claim 15, wherein the engaging structure comprises at least one connecting base disposed on at least one end of the handle, the notch is on the at least one connecting base, and the at least one connecting base is disposed on the at least one stand in a height-adjustable manner.

17. The child crib of claim 15, wherein the at least one interlocking component is slidable between a first position and a second position, the at least one interlocking component engages with the positioning structure when the at least one interlocking component is located at the first position, and the at least one interlocking component disengages from the positioning structure when the at least one interlocking component is located at the second position.

18. The child crib of claim 17, wherein a hole is on the at least one interlocking component, and the handle adjustment mechanism further comprises at least one pin slidably disposed in the hole.

19. The child crib of claim 15, wherein an inclined surface and a limiting portion are on the first end of the at least one interlocking component, the inclined surface is inclined upwardly and configured to cooperate with the positioning structure to drive the at least one interlocking component, and the limiting portion is configured to restrict movement of the at least one interlocking component.

20. The child crib of claim 15, wherein the engaging structure further comprises at least one operator for driving the at least one movable component when the at least one operator is operated.

21. The child crib of claim 20, wherein the handle adjustment mechanism further comprises a base on the handle, the at least one operator is disposed on the base.

22. The child crib of claim 21, wherein the base comprises at least one guiding slot extending horizontally, the at least one operator comprises at least one driving slot, a first end of the at least one movable component is connected to the at least one interlocking component, a second end of the at least one movable component is disposed inside the at least one driving slot and the at least one guiding slot, and the second end of the at least one movable component is moved horizontally and inwardly by a cooperation between the second end of the at least one movable component, the at least one driving slot and the at least one guiding slot when the at least one operator slides.

23. The child crib of claim 21, wherein the handle comprises at least one guiding slot extending horizontally, the at least one operator comprises at least one driving slot, a first end of the at least one movable component is connected to the at least one interlocking component, a second end of the at least one movable component is disposed inside the at least one driving slot and the at least one guiding slot, and the second end of the at least one movable component is moved horizontally and inwardly by a cooperation between the second end of the at least one movable component, the at least one driving slot and the at least one guiding slot when the at least one operator rotates.

24. The child crib of claim 20, wherein the handle adjustment mechanism further comprises a base and at least one slider, the base is on the handle, the at least one slider is disposed on the base, the at least one operator is rotatably disposed on the base for driving the at least one slider to slide, a first end of the at least one movable component is connected to the at least one interlocking component, a second end of the at least one movable component is connected to the at least one slider, and the at least one operator rotates to drive the at least one slider to slide for driving the second end of the at least one movable component to move inwardly.

25. The child crib of claim 20, wherein the handle adjustment mechanism further comprises a base and at least one gear, the base is on the handle, the at least one gear is disposed on the base, the at least one operator is disposed on the base for driving the at least one gear to rotate, the at least one gear comprises a connector, a first end of the at least one movable component is connected to the at least one interlocking component, a second end of the at least one movable component is coupled to the connector, and the at least one operator is operated to drive the at least one gear to rotate for driving the second end of the at least one movable component to move inwardly.

26. The child crib of claim 25, wherein the at least one gear comprises two gears meshed with each other.

* * * * *